US005977930A

United States Patent [19]

Fischer et al.

[11] Patent Number: 5,977,930

[45] Date of Patent: Nov. 2, 1999

[54] PHASED ARRAY ANTENNA PROVIDED WITH A CALIBRATION NETWORK

[75] Inventors: Henk Fischer, EN Hengelo; Antonius B. M. Klein Breteler, VA Neede, both of Netherlands

[73] Assignee: Hollandse Signaalapparaten B.V., Hengelo, Netherlands

[21] Appl. No.: 08/913,950

[22] PCT Filed: Mar. 13, 1996

[86] PCT No.: PCT/EP96/01146

§ 371 Date: Sep. 29, 1997

§ 102(e) Date: Sep. 29, 1997

[87] PCT Pub. No.: WO96/30963

PCT Pub. Date: Oct. 3, 1996

[30] Foreign Application Priority Data

Mar. 27, 1995 [NL] Netherlands ..... 9500580

[51] Int. Cl.[6] ..... H01Q 21/00; H01Q 13/00

[52] U.S. Cl. ..... 343/853; 343/772; 343/776; 343/778

[58] Field of Search ..... 343/853, 776; 333/161, 126; 342/375

[56] References Cited

U.S. PATENT DOCUMENTS 4,742,355 5/1988 Wolfson et al. ..... 342/375
5,014,022 5/1991 Wolfson et al. ..... 333/161

*Primary Examiner*—Don Wong
*Assistant Examiner*—Jennifer H. Malos
*Attorney, Agent, or Firm*—Oblon, Spivak, McClelland, Maier & Neustadt, P.C.

[57] ABSTRACT

A phased array antenna including a number of waveguide radiators in a power supply system. A calibration network provides a test pulse. By directly connecting the calibration network to the waveguide radiators, a more accurate calibration is obtained due to the processing of any phase and amplitude errors arising in the waveguide radiators in a calibration algorithm. The calibration network can be designed as a system of waveguides.

8 Claims, 4 Drawing Sheets

PHASED ARRAY ANTENNA PROVIDED WITH A CALIBRATION NETWORK

BACKGROUND OF THE INVENTION

1. Field of the Invention

The invention relates to a phased array antenna comprising an array of waveguide radiators connected to a supply system and furthermore comprising a calibration network for calibrating the supply system.

DISCUSSION OF THE BACKGROUND

A phased array antenna of this type is known from the European patent specification EP-B 0.110.260. This patent specification describes a pulse radar apparatus comprising a coherent transmitting and receiving unit incorporating a transmitter, a transmitting antenna, a number of receiving antennas connected to coherent receivers which are suitable for converting, by phase-coherent detection, echo signals into quadrature video signals having two components. The coherent transmitting and receiving unit additionally incorporates a beam former, the transmitter being suitable for the transmission of test signals in a test phase in the course of which the test signals are injected into the receiver channels. On the basis of the video signals generated by the receivers, the amplitude and phase-correcting signals are determined which are representative of the amplitude and phase errors introduced by the receivers. The need to provide a calibration or test network stems from the fact that differences in gain and phase of the receivers may constitute an impediment to a desired side-lobe reduction. The drawback of the prior art phased array antenna is that the test signal is injected directly into the receiver channels. As a result, phase and amplitude errors generated beyond the receiver channels, for instance in the connection between receiver and waveguide radiators and in a transformer element generally comprised in the waveguide radiators, are not included in the test procedures and, hence, are not compensated for. A possible solution is to inject the test signal by means of a separate feedhorn to be placed in front of the antenna. This however has the drawback that compensation is also required for errors caused by the distance between the feedhorn and a waveguide radiator being different for each waveguide radiator.

SUMMARY OF THE INVENTION

The phased array antenna according to the invention has for its object to provide a solution to this problem by injecting the test signal directly into at least substantially all waveguide radiators. This entails the advantage that phase and amplitude errors generated in the waveguide radiators are also included in the test procedure. It is characterized in that at least substantially all waveguide radiators comprise a coupling device connected to the calibration network.

In phased array antennas provided with waveguide radiators, the supply system generally comprises a T/R module per waveguide radiator or per group of waveguide radiators. As a result there is insufficient room at the input to provide a coupling device to be connected to the calibration network. At the output of a waveguide radiator there is no room available either for a coupling device to be connected to the calibration network, as the output has to be free from obstacles in order to ensure an undisturbed emission of radiant energy. A special embodiment offers a solution to the above-mentioned problem and is thereto characterized in that the coupling device is mounted at a side wall of the waveguide radiators.

The calibration network is required to ensure a low-loss transmission of microwave energy. To this end, use is generally made of a stripline network in which Duroid generally serves as a dielectric. Such a network is however very expensive. A favorable embodiment of the phased array antenna according to the invention is aimed at realising a far less expensive calibration network and is thereto characterized in that the calibration network comprises at least one waveguide.

If the waveguide-shaped calibration network is mounted between the waveguide radiators such that it abuts on the side walls of the waveguide radiators, due care should be taken that the distance between the rows of waveguide radiators is kept as small as possible, notwithstanding the presence of the waveguide. This can be effected by making the widest side wall of the waveguide abut on the waveguide radiators so that the distance between the rows of waveguide radiators is determined by the narrowest waveguide side wall. A further favorable embodiment is therefore characterized in that the widest side wall of the waveguide abuts on the widest side walls of the waveguide radiators.

The embodiment whose calibration network comprises at least one waveguide can be extended to a system of waveguides which spans a number of waveguide radiators arranged in rows whereby each waveguide radiator is connected to the waveguide. Per row of waveguide radiators, preferably one waveguide may be provided which is placed at right angles to the corresponding row of waveguide radiators. A further favorable embodiment is therefore characterized in that the at least one waveguide is placed at least substantially at right angles to the waveguide radiators.

The last-mentioned embodiment can be used to advantage by realizing the coupling device of each waveguide radiator as a connection between the waveguide and the waveguide radiator in question. A further favorable embodiment is thereto characterized in that the coupling device of each waveguide radiator constitutes a connection between the waveguide radiator and the waveguide.

The connection between waveguide radiator and calibration network waveguide can now simply and effectively be realised by providing one or several apertures in the side wall of the waveguide and the waveguide radiator. A further favorable embodiment is therefore characterized in that the connection comprises at least an aperture in the waveguide radiator side wall and an aperture in a waveguide side wall, which apertures coincide.

When applying a test pulse it may be important to prevent the test pulse energy from being emitted at the antenna output side, for instance in the event that radar silence is desired, but calibration is nevertheless required. This can be effected by providing the coupling device with a directional coupler which substantially couples energy in the direction of the power supply system. A further favorable embodiment is therefore characterized in that the coupling device per waveguide radiator comprises a directional coupling with a directivity substantially in the direction of the power supply system.

If the calibration network comprises one or several waveguides with a connection between each waveguide radiator and the corresponding waveguide, it is advantageous to keep the coupled test signal energy as low as possible, so that sufficient energy remains available for more distant waveguide radiators. In this respect it is advisable that each waveguide radiator receives substantially the same portion of energy. A further favorable embodiment is thereto characterized in that the connection effects a signal attenuation of −35 dB to −45 dB.

By providing a number of rows of waveguide radiators with a waveguide-shaped calibration network it is possible to connect several waveguides for instance by means of 180-degree waveguide bends at the end of a waveguide pertaining to a row of waveguide radiators, which bends connect the output of the waveguide to the input of a parallel waveguide pertaining to a next row of waveguide radiators. In this manner the calibration network can be extended and a single power supply source will be sufficient for applying a test signal at the calibration network input. A favorable embodiment is thereto characterized in that the at least one waveguide comprises a number of waveguides, the output of one waveguide being connected to the input of another waveguide.

By connecting a signal generator producing signals of sufficient strength to the output of the calibration network implemented as at least one waveguide whereby each waveguide radiator receives only a relatively small quantity of microwave energy, the microwave radiation is evenly spread over the waveguide radiators. As a result, a certain quantity of microwave radiation will be present at the output of the calibration network beyond the connected waveguide radiators to be retained by a matched load. A favorable embodiment is therefore characterized in that the at least one waveguide is on one end connected to a calibration signal generator and on the other end comprises a matched load.

DESCRIPTION OF THE DRAWINGS

The phased array antenna according to the invention will now be described in greater detail with reference to the following figures, of which.

DISCUSSION OF THE PREFERRED EMBODIMENTS

Figure 1:
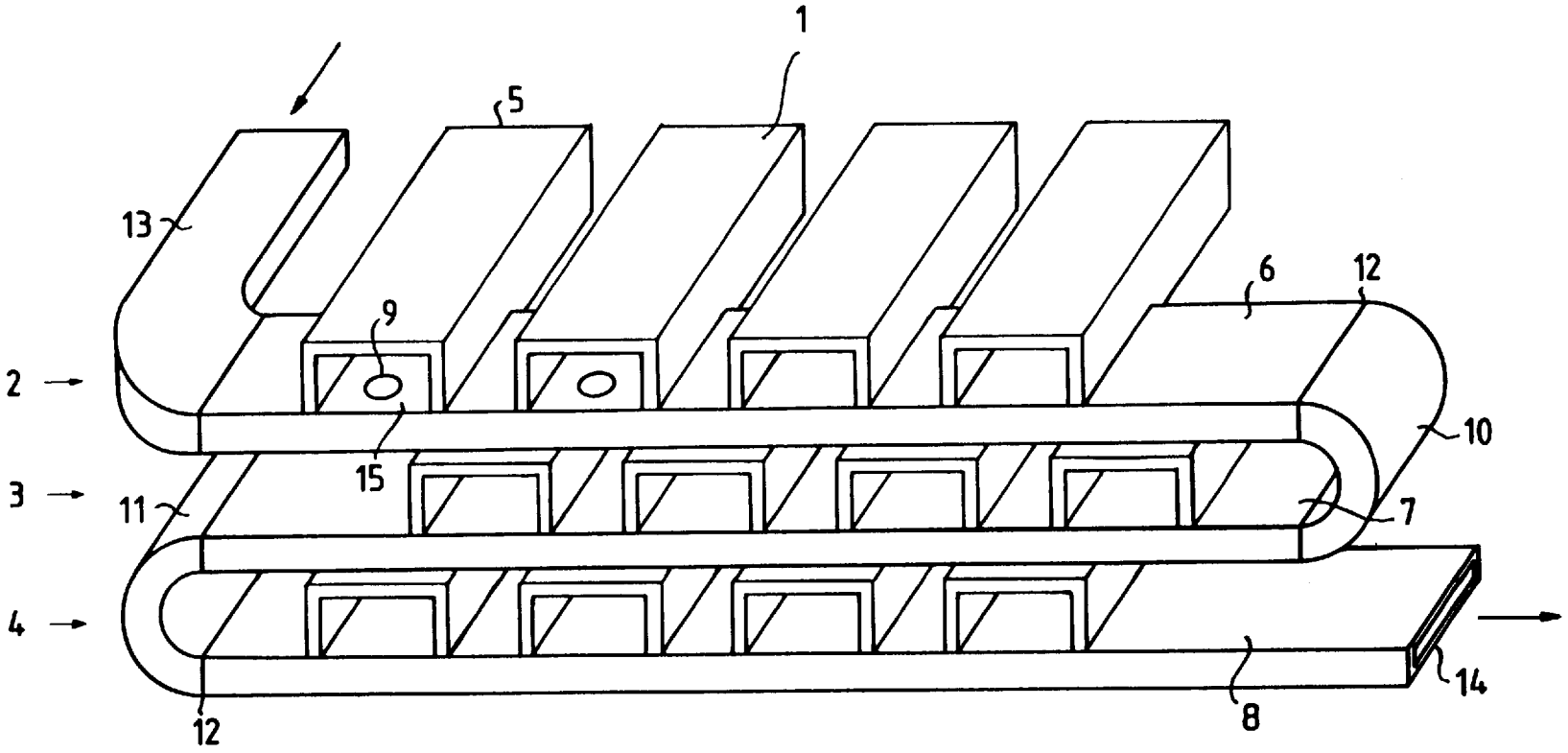
FIG. 1 represents an array of waveguide radiators according to the first embodiment of the invention.

FIG. 1 represents a front view of an array of waveguide radiators 1, comprising a calibration network according to a first embodiment of the invention. The waveguide radiators are arranged to lie in an upper 2, middle 3 and bottom row 4. The exemplary embodiment comprises only three rows, but in actual practice there will be dozens of rows and accordingly, several dozens of waveguide radiators per row. The waveguide radiators in each row are shifted over a half a center-to-center distance between two waveguide radiators with respect to the adjacent rows. This yields a favorable low-sidelobe antenna diagram. This is however not strictly necessary. At the front side, an iris plate (not shown) will generally be provided to prevent crosstalk from one waveguide radiator to another. At the back 5, the waveguide radiators are generally connected to a backplane (not shown). The backplane enhances the antenna rigidity and serves to establish the electrical connection between the waveguide radiators with their corresponding T/R (Transmit/Receive) modules. In order to compensate for phase and amplitude errors which may arise per T/R module generally as a result of production inaccuracies or temperature drift, correction factors are determined per T/R module which are used for the control of the T/R module in question. To this end, each individual T/R module is at set times provided with a test signal having a known phase and amplitude. In order to provide the T/R modules with such a test signal, a calibration network might for instance be fitted between the backplane and the T/R modules. This has several drawbacks, though. Firstly, space should be created between the T/R modules and the backplane to accommodate the calibration network. To bridge this gap, a connecting line has to be mounted between each waveguide radiator and related T/R module, which entails losses. Secondly, phase and amplitude errors arising past the backplane are not included in the correction procedure. In the exemplary embodiment the calibration network comprises a number of waveguides 6, 7, 8 which are mounted along the widest side walls of the waveguide radiators. Each waveguide radiator comprises a coupling device 9 shaped as a hole, which is illustrated for one waveguide radiator only. The coupling device is preferably designed as a prior art directional coupling, the coupling of energy being substantially in the direction of the backplane. Directional couplers can for instance be designed as two diagonal holes in the rectangle formed by the overlap of the waveguide and a waveguide radiator. A coupling device is required only for those waveguide radiators to be calibrated. This generally obtains for all waveguide radiators, although it is not strictly necessary. It is also possible to make several holes per waveguide radiator. The waveguides 6, 7, 8 are interconnected by waveguide bends 10, 11, which can be attached by means of flanges 12. Consequently, one test signal suffices for the entire system of waveguides. The system of waveguides curves towards the backplane via a bend 13 which renders the backplane suitable for providing a test signal. At the end 14 of the system of waveguides, a matched load (not shown) is preferably provided to avoid test signal reflections. It is of course also possible to provide, per row of radiating elements, each waveguide with a test signal and a matched load. Bends 10, 11 are then omitted. In the event of a test signal generator failure, it is still possible to provide the other rows with a test signal. In the exemplary embodiment, the waveguide radiators consist of rectangular elements, the lower side walls of which have been removed at the waveguide interface. The top 15 of the waveguide thus constitutes the lower side wall. This has the advantage that only the waveguide has to be provided with one or more holes.

Figure 2A:
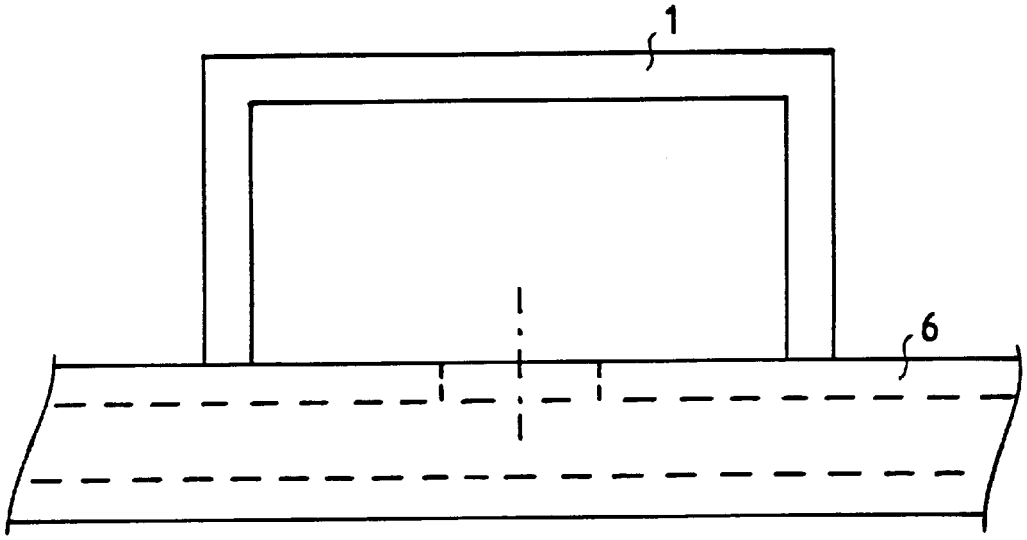
FIG. 2A represents a front view of a waveguide radiator according to the first embodiment of the invention.
Figure 2B:
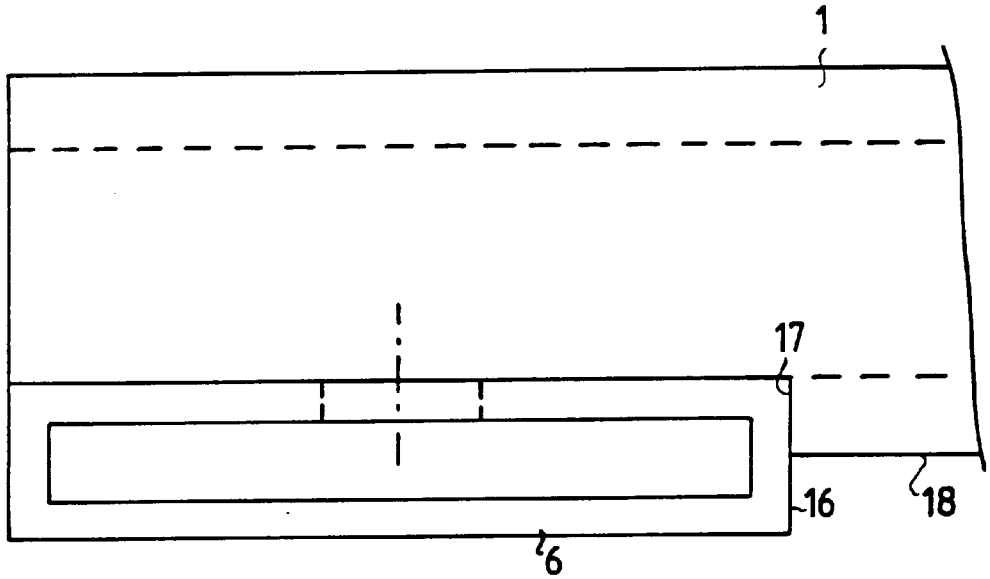
FIG. 2B represents a side view of a waveguide radiator according to the first embodiment of the invention.

FIG. 2A and FIG. 2B show a magnified view of a waveguide radiator 1. The waveguide radiator is rectangular in shape. At the waveguide 6, it has an inverted U-shape, owing to the lower side wall having been removed. Behind the waveguide, the waveguide radiator continues as a rectangular element, as shown in FIG. 2B. This way, the narrow back sidewall 16 of the waveguide 6 thus abuts on the raised edge 17 of the waveguide radiators where the lower side wall 18 of the waveguide radiators starts and continues in the direction of the backplane. This enables the waveguide radiators to be correctly positioned during assembly.

Figure 3:
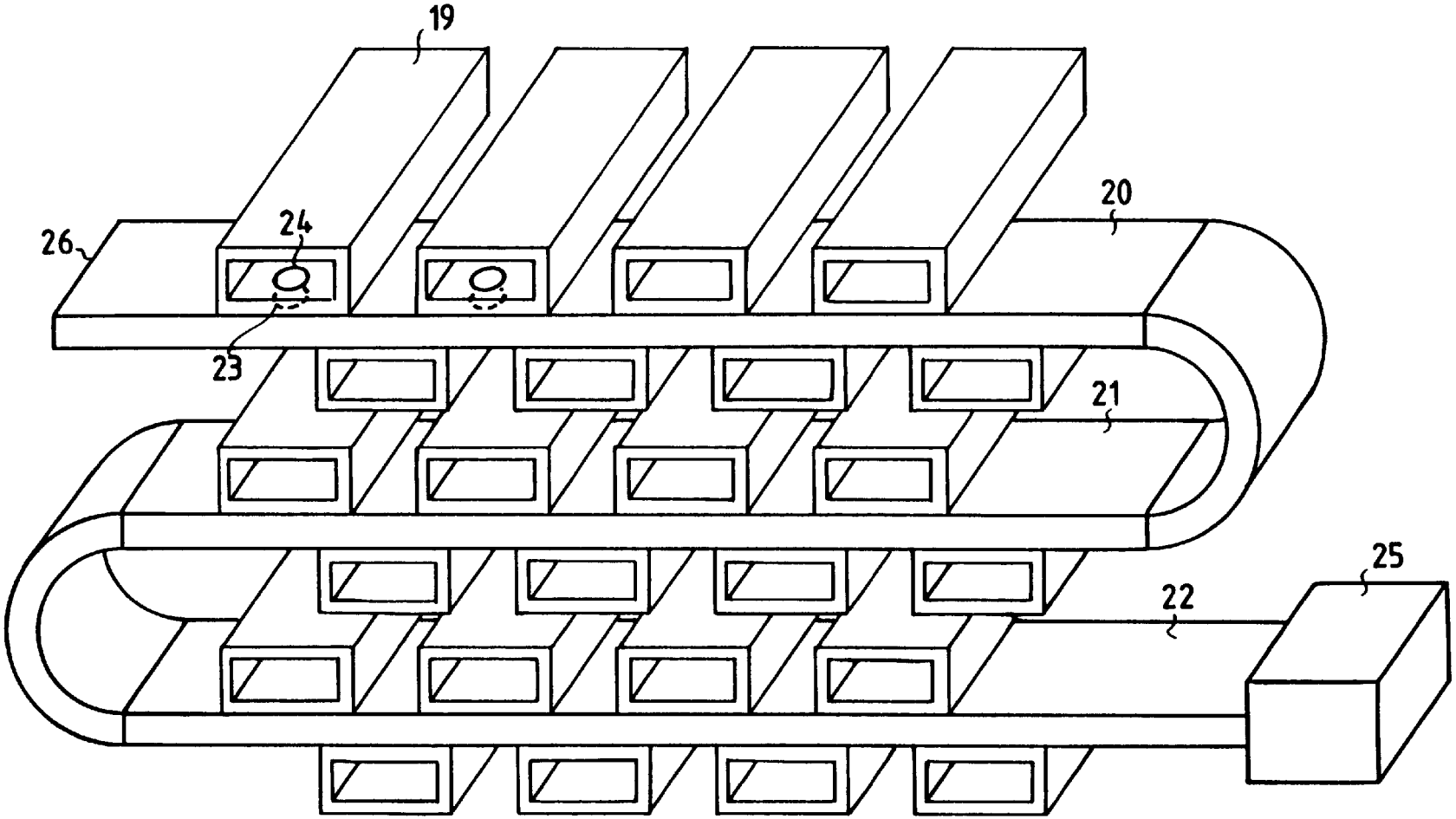
FIG. 3 represents an array of waveguide radiators according to a second embodiment of the invention.

FIG. 3 shows a second embodiment of the phased array antenna provided with the calibration network according to the invention. The waveguide radiators 19 are mounted on both sides of the waveguides. This effects a 50% reduction of the required length of waveguide 20, 21, 22. The waveguides 20, 21, 22 are on both sides provided with holes 23 at the waveguide radiators for the coupling of a test pulse. The waveguide radiators 19 are provided with corresponding holes 24. In the exemplary embodiment, the waveguide radiators are rectangular throughout their entire length. A matched load 25 is mounted at the end of the waveguide 22. The test pulse is introduced at the input 26 of the waveguide 20.

Figure 4:
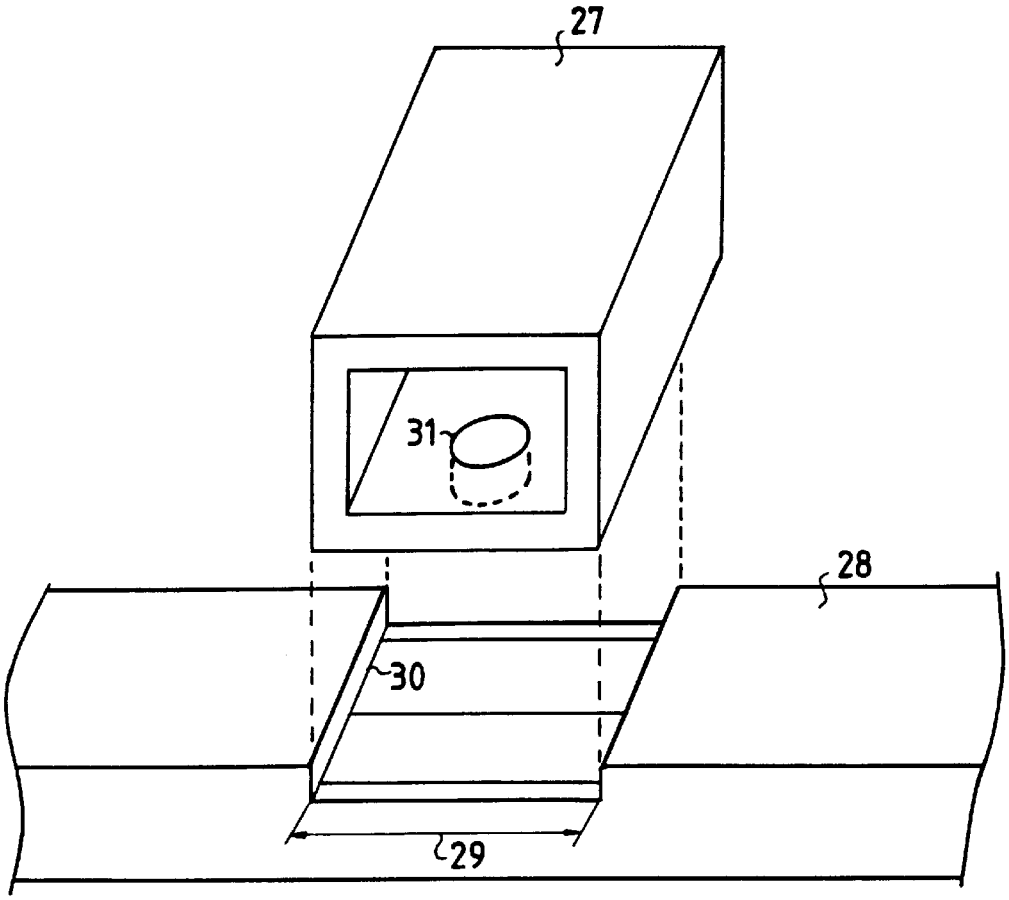
FIG. 4 represents an exploded view of a feasible method of attaching a waveguide radiator to the waveguide of the calibration network.

FIG. 4 shows a method of attaching a rectangular waveguide radiator 27 to the waveguide 28 of the calibration network that differs from that shown in FIG. 1. A section 29 having the width of a waveguide radiator side wall has been removed from the upper side wall 30 of the waveguide 28. This creates a recess which substantially accurately fits the rectangular waveguide radiator 27. The waveguide radiator is provided with a hole 31 to enable the coupling of radiant energy.

Phased array antennas according to the invention are by no means restricted to the above-mentioned embodiments. Features from the above-mentioned embodiments can be applied in combination.

We claim:

1. A phased array antenna comprising:

a two-dimensional array of waveguide radiators connected to a supply system; and a calibration network configured to calibrate the antenna, and including a waveguide having a coupling device mounted to a side wall of each of a predetermined number of waveguide radiators of the array of waveguides radiators, said calibration network being arranged for leading a test signal to each of the predetermined number of waveguide radiators simultaneously, wherein said coupling device comprises a directional coupler having a main directivity in a direction of the supply system, and a widest side wall of the waveguide abuts on the widest side walls of the array of waveguide radiators.

2. The phased array antenna according to claim 1, wherein the array of waveguide radiators and the waveguide comprise a rectangular cross section, and the coupling device comprises a first hole and a second hole, located on a diagonal of a rectangular region formed by an overlap of the waveguide and the respective waveguide radiator of the array of waveguide radiators.

3. The phased array antenna according to claim 1, wherein the coupling device effects a signal attenuation of −35 to −45 dB.

4. The phased array antenna according to claim 1, wherein said waveguide radiators are mounted only on a first side of said waveguide.

5. The phased array antenna according to claim 1, wherein the waveguide radiators are mounted on first and second sides of said waveguide.

6. The phased array antenna according to claim 1, wherein said waveguide comprises a rectangular shape and includes a corresponding number of recesses to be fitted with respective waveguide radiators.

7. The phased array antenna according to claim 1, wherein said waveguide radiators comprise a recess portion to be fitted with said waveguide.

8. The phased array antenna according to claim 1, wherein the waveguide radiators are arranged in at least first, second and third rows and are positionally offset from respective waveguide radiators in adjacent rows.

* * * * *